US008088997B2

(12) United States Patent
Picard et al.

(10) Patent No.: US 8,088,997 B2
(45) Date of Patent: Jan. 3, 2012

(54) METAL SHEATHED CABLE ASSEMBLY

(75) Inventors: Paul R. Picard, East Greenwich, RI (US); Joseph D. Colangelo, Chepachet, RI (US); Robert A. Pereira, Rochester, MA (US); Christopher J. DeMello, Swansea, MA (US)

(73) Assignee: WPFY, Inc., Wilmington, DE (US)

( * ) Notice: Subject to any disclaimer, the term of this patent is extended or adjusted under 35 U.S.C. 154(b) by 211 days.

(21) Appl. No.: 12/419,634

(22) Filed: Apr. 7, 2009

(65) Prior Publication Data

US 2009/0250238 A1 Oct. 8, 2009

Related U.S. Application Data

(60) Provisional application No. 61/043,316, filed on Apr. 8, 2008, provisional application No. 61/043,546, filed on Apr. 9, 2008, provisional application No. 61/057,795, filed on May 30, 2008.

(51) Int. Cl.
*H01B 7/00* (2006.01)

(52) U.S. Cl. ..... 174/36; 174/102 R; 174/113 R

(58) Field of Classification Search ..... 174/36, 174/102 R, 106 R, 108, 113 R, 105 R, 116
See application file for complete search history.

(56) References Cited

U.S. PATENT DOCUMENTS 2,866,843 A 12/1958 Arman
3,032,604 A * 5/1962 Timmons ..... 174/115
3,829,603 A * 8/1974 Hansen et al. ..... 174/115
4,374,299 A * 2/1983 Kincaid ..... 174/36
4,943,699 A 7/1990 Thommes
4,956,523 A 9/1990 Pawluk
5,043,538 A 8/1991 Hughey, Jr. et al.
5,220,130 A 6/1993 Walters
5,246,783 A 9/1993 Spenadel et al.
5,281,762 A 1/1994 Long et al.
5,329,064 A 7/1994 Tash et al.
5,329,065 A * 7/1994 Marney et al. ..... 174/128.1
5,414,217 A 5/1995 Neuroth et al.
5,416,268 A 5/1995 Ellis
5,426,264 A 6/1995 Livingston et al.
5,431,759 A 7/1995 Neuroth
5,451,718 A 9/1995 Dixon
5,486,649 A 1/1996 Gareis
(Continued)

OTHER PUBLICATIONS

UL Standard for Safety for Metal-Clad Cables, UL 1569, "Metal-Clad Cables", Third Edition, dated Aug. 31, 1999, Redacted pp. 9,10,14, 21, 31, 46A-46C, 46D-48, 54A.

*Primary Examiner* — William Mayo, III
(74) *Attorney, Agent, or Firm* — Kacvinsky Daisak, PLLC

(57) ABSTRACT

A Metal-Clad cable that includes at least two conductor assemblies within a metal armored sheath. Each conductor assembly has an electrical conductor, an insulation layer extending around and along the length of each of the electrical conductors, a jacket layer disposed around the insulating layer and a polymeric protective layer disposed around the jacket layer along the length of each of the electrical conductors. A grounding/bonding strip is disposed within the cable and is in intimate contact with an interior surface of the metal sheath. If a grounding conductor is used, it is either in cabled relationship with the two conductor assemblies or is disposed along the length of the electrical conductors and the metal sheath is disposed over the at least two conductor assemblies and the grounding conductor.

25 Claims, 14 Drawing Sheets

U.S. PATENT DOCUMENTS

| | | | | |
|---|---|---|---|---|
| 5,574,250 | A | 11/1996 | Hardie | |
| 5,920,032 | A | 7/1999 | Aeschbacher et al. | |
| 6,010,788 | A | 1/2000 | Kebabjian et al. | |
| 6,255,592 | B1 | 7/2001 | Pennington et al. | |
| 6,281,443 | B1 | 8/2001 | Idler | |
| 6,485,335 | B1 | 11/2002 | Dewdney | |
| 6,486,395 | B1 * | 11/2002 | Temblador | 174/36 |
| 6,743,387 | B2 | 6/2004 | Belli et al. | |
| 6,815,617 | B1 | 11/2004 | Gebs | |
| 6,906,264 | B1 * | 6/2005 | Grant et al. | 174/112 |
| 6,998,538 | B1 | 2/2006 | Fetterolf et al. | |
| 7,049,506 | B2 | 5/2006 | Head | |
| 7,129,415 | B1 | 10/2006 | Bates et al. | |
| 7,148,422 | B2 | 12/2006 | Hopper | |
| 7,166,802 | B2 * | 1/2007 | Cusson et al. | 174/113 R |
| 7,332,676 | B2 | 2/2008 | Sparrowhawk | |
| 2001/0040041 | A1 | 11/2001 | Pennington et al. | |
| 2004/0065469 | A1 | 4/2004 | Goldlust et al. | |
| 2006/0102380 | A1 | 5/2006 | Hu | |
| 2007/0056762 | A1 | 3/2007 | Cusson et al. | |
| 2008/0050588 | A1 | 2/2008 | Broman et al. | |
| 2008/0217044 | A1 | 9/2008 | Carlson et al. | |
| 2009/0250239 | A1 | 10/2009 | Picard et al. | |

* cited by examiner

METAL SHEATHED CABLE ASSEMBLY

CROSS-REFERENCE TO RELATED APPLICATIONS

This application claims priority to U.S. Provisional Application No. 61/043,316 filed Apr. 8, 2008; U.S. Provisional Application No. 61/043,546 filed Apr. 9, 2008; and U.S. Provisional Application No. 61/057,795 filed May 30, 2008; all of which are herein incorporated by reference in their entirety.

BACKGROUND

1. Field of the Invention

The present invention is directed toward a Metal-Clad type cable. More particularly, the present invention relates to a Metal-Clad type metal cable assembly which includes electrical conductors each having a conventional layer of insulation, a jacketing layer and an extruded protective layer.

2. Discussion of Related Art

Armored cable ("AC") and Metal-Clad ("MC") cable provide electrical wiring in various types of construction applications. The type, use and composition of these cables must satisfy certain standards as set forth, for example, in the National Electric Code (NEC®). These cables house electrical conductors within a metal armor. The metal armor may be flexible enabling the cable to bend while protecting the conductors against external damage during and after installation. The armor which houses the electrical conductors may be made from steel or aluminum. Typically, the metal armor sheath is formed from strip steel, for example, which is helically wrapped to form a series of interlocked "S" shaped sections along a longitudinal length of the cable. Alternatively, the sheaths may be made from smooth or corrugated metal.

Generally, AC and MC cable have different internal constructions and performance characteristics and are governed by different standards. For example, AC cable is manufactured to UL Standard 4 and can contain up to four (4) insulated conductors individually wrapped in a fibrous material which are cabled together in a left hand lay. Each electrical conductor is covered with a thermoplastic insulation and a jacket layer. The conductors are disposed within a metal armor or sheath. If a grounding conductor is employed, the grounding conductor is either (i) separately covered or wrapped with the fibrous material before being cabled with the thermoplastic insulated conductors; or (ii) enclosed in the fibrous material together with the insulated conductors for thermoset insulated conductors. In either configuration, the bare grounding conductor is prevented from contacting the metal armor by the fibrous material. Additionally in type AC cable, a bonding strip or wire is laid lengthwise longitudinally along the cabled conductors and the assembly is fed into an armoring machine process. The bonding strip is in intimate contact with the metal armor or sheath providing a low-impedance fault return path to safely conduct fault current. The bonding wire is unique to AC cable and allows the outer metal armor in conjunction with the bonding strip to provide a low impedance equipment grounding path.

In contrast, MC cable is manufactured according to UL standard 1569 and includes a conductor assembly with no limit on the number of electrical conductors having a particular AWG (American Wire Gauge). The conductor assembly may contain a grounding conductor. The electrical conductors and the ground conductor are cabled together in a left or right hand lay and encased collectively in an overall covering.

Similar to AC cable, the assembly is then fed into an armoring machine where metal tape is helically applied around the assembly to form a metal sheath. The metallic sheath of continuous or corrugated type MC cable may be used as an equipment grounding conductor if the ohmic resistance satisfies the requirements of UL 1569. A grounding conductor may be included which, in combination with the metallic sheath, would satisfy the UL ohmic resistance requirement. In this case, the metallic sheath and the grounding/bonding conductor would comprise what is referred to as a metallic sheath assembly.

As mentioned above, prior AC cables include a fibrous cover over each of the electrical conductors and if a grounding conductor is used, the fibrous material is disposed between the grounding conductor and the metal armored sheath. MC cable includes either a covering over all of the electrically insulated conductors and the grounding conductor after cabling or a covering over just the electrical insulated conductors combined after cabling while the grounding conductor is positioned externally separate from this overall covering. This covering material is typically a nonmetallic material composed of polypropylene or polyester. However, this covering material does not provide conductor to conductor mechanical protection nor does it provide protection within an enclosure such as a junction box or panel when the cable is installed therein. Thus, there is a need for an improved MC armored cable that provides added mechanical protection to the conductors housed within an electrical cable assembly.

SUMMARY OF THE INVENTION

Exemplary embodiments of the present invention are directed to a Metal-Clad cable. In an exemplary embodiment, the Metal-Clad cable includes at least two conductor assemblies, a grounding conductor and a metal sheath. Each conductor assembly has an electrical conductor, a conventional layer of insulation extending around and along the length of each of the electrical conductors and a polymeric protective layer disposed around the insulation layer along the length of each of the electrical conductors. The electrical conductor may also have a jacket layer over the insulation layer. If a grounding conductor is used, it is in cabled relationship with the two conductor assemblies and the metal sheath is disposed over the at least two conductor assemblies and the grounding conductor.

DESCRIPTION OF EMBODIMENTS

Figure 1:
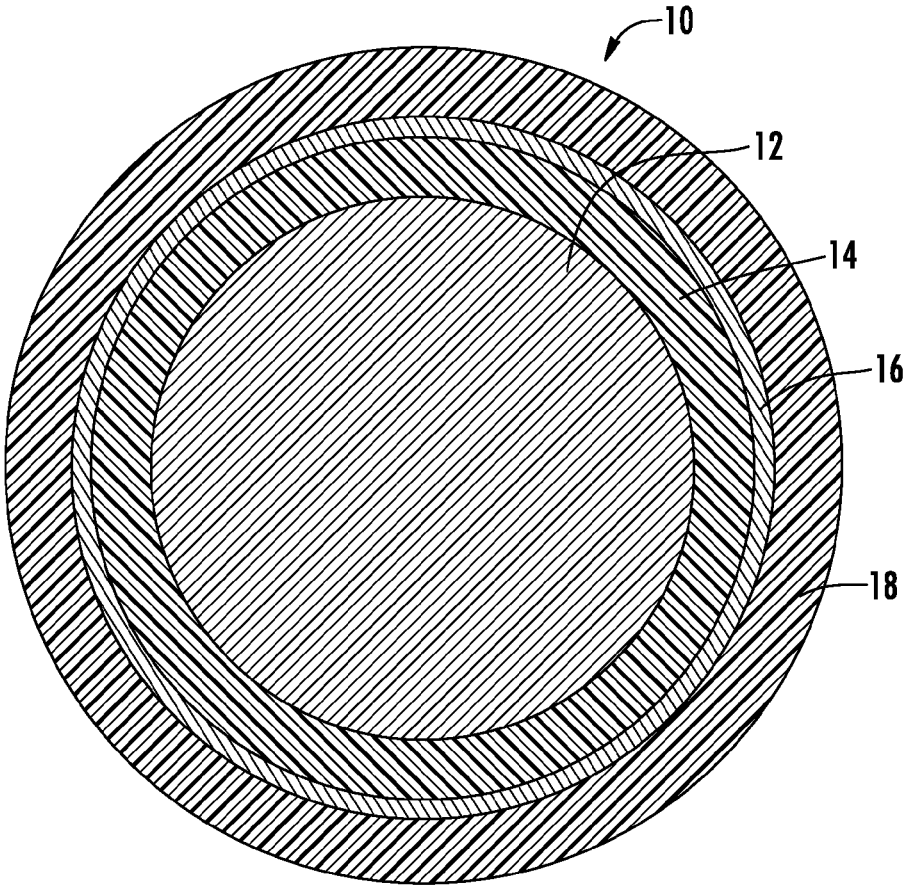
FIG. 1 is a cross sectional view of an exemplary electrical conductor assembly in accordance with the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

FIG. 1 is a cross sectional view of an exemplary electrical conductor assembly 10 used in an MC cable. The electrical conductor assembly 10 includes a stranded or solid electrical conductor 12 having conventional concentric insulation layer(s) 14 and a jacket layer 16 disposed on conventional insulation layer 14. The electrical conductor 12, insulation layer 14 and jacket layer 16 define an NEC® Type THHN or THWN insulated conductor where the insulation layer 14 may be PVC and jacket layer 16 may be nylon. A polymeric protective layer 18 is disposed on jacket layer 16 and more particularly, is extruded over jacket layer 16. Protective layer 18 is polypropylene, but may also be made from other comparable materials such as, but not limited to, polyethylene, polyester, etc. Protective layer 18 may be a foamed polymeric material that includes air pockets filled with gasses, some or all of which may be inert. Alternatively, the polymeric protective layer 18 may be extruded over insulation layer 14 as described with reference to FIG. 1A. and may also provide proper positioning and tensioning of a ground conductor as described below. The protective layer 18 may also be pliable to provide a conforming surface to that of the inside of the metal sheath or adjacently positioned conductor assemblies.

Figure 1A:
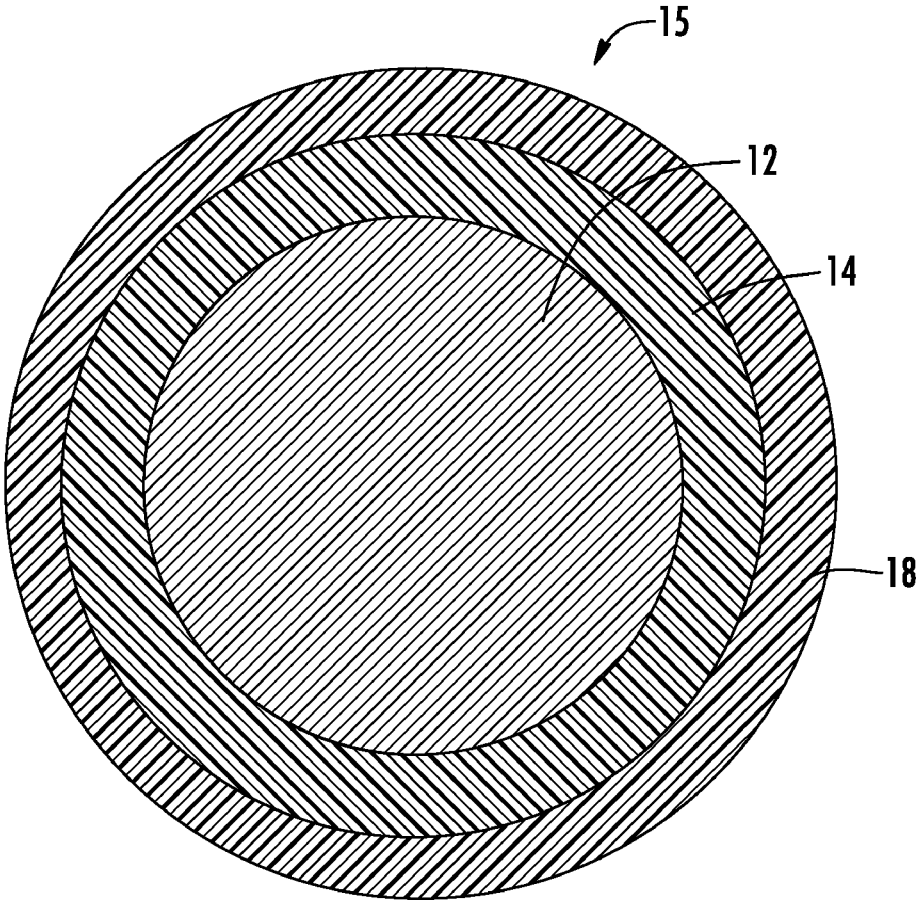
FIG. 1A is a cross sectional view of an exemplary electrical conductor assembly in accordance with the present invention.

FIG. 1A is a cross sectional view of an electrical conductor assemble 15 including a stranded or solid electrical conductor 12 having conventional insulation layer 14 and a protective layer 18. Unlike the conductor assembly 10 of FIG. 1 where the protective layer 18 is disposed over the jacket layer 16, the protective layer 18 of conductor assembly 15 is disposed over insulation layer 14. Protective layer 18 is polypropylene, but may also be made from other comparable materials such as, but not limited to, polyethylene, polyester, etc. Protective layer 18 may be a foamed polymeric material that includes air pockets filled with gasses, some or all of which may be inert. Protective layer 18 provides mechanical strength to resist buckling, crushing and scuffing of the conductor assembly 15.

Figure 2:
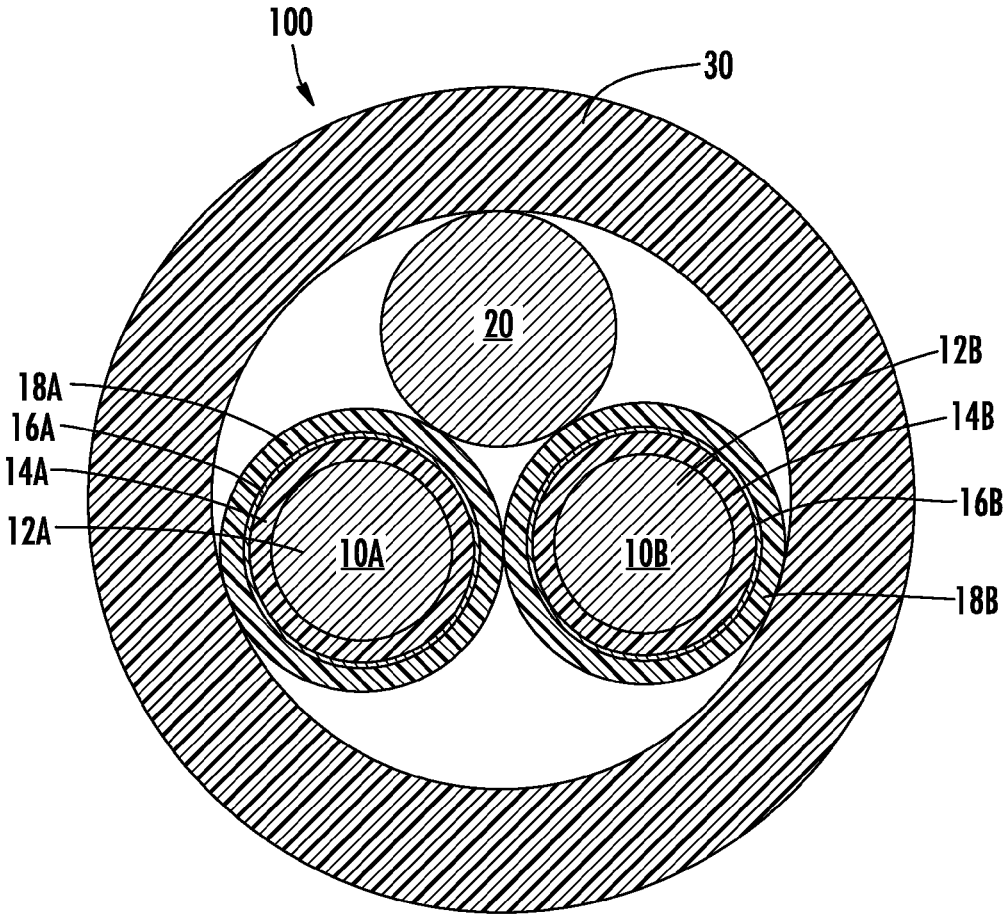
FIG. 2 is a cross-section view of an exemplary MC cable 100 in accordance with the present invention.

FIG. 2 is a cross sectional view of an MC cable 100 including a metal sheath 30 housing electrical conductor assemblies 10A and 10B and a grounding/bonding conductor 20. The electrical conductor assemblies 10A-B have the same configuration as conductor assembly 10 shown in FIG. 1. The metal sheath 30 has a generally circular cross section with a thickness of about 0.010 to about 0.040 inches. Sheath 30 may be formed as a seamless continuous sheath or alternatively formed from flat or shaped metal strip, the edges of which are helically wrapped and interlock to form a series of "S" shaped convolutions along the length of the cable. In this manner, the metal sheath allows the cable 100 to have a particular bend radius sufficient for installation within a building or structure. The sheath may also be formed into shapes other than generally circular such as, for example, rectangles, polygons, ovals and the like. Sheath 30 provides a protective metallic covering around the electrical conductor assemblies 10A, 10B and the grounding conductor 20.

Figure 2A:
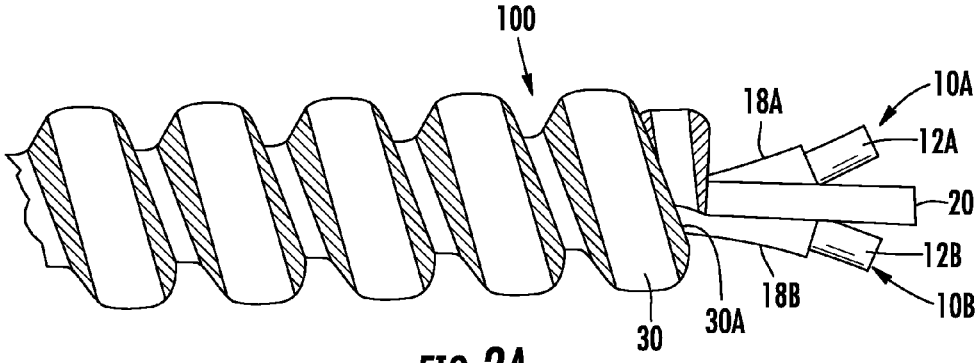
FIG. 2A is a side plan view of an exemplary MC cable 100 in accordance with the present invention.

FIG. 2A is a side plan view of cable 100 illustrating metallic sheath 30 sized to receive at least two insulated electrical conductor assemblies 10A, 10B as well as at least one grounding/bonding conductor 20. The conductor assemblies 10A-B may comprise, for example, No. 12 AWG solid electrical conductors 12A-B. Each electrical conductor assembly 10A-B includes a protective layer 18A-B, respectively. The protective layer 18A-B is a polymeric material adapted for extrusion about the conventional layers (insulating layers 14 and jacket layers 16) of conductors 12A-B. Grounding/bonding conductor 20 is disposed within metal sheath 30 and may be cabled with conductor assemblies 10A-B. Alternatively, grounding/bonding conductor 20 may not be cabled with the conductor assemblies, but rather extends longitudinally along the metallic sheath 30 such that the longitudinal axis of the grounding/bonding conductor 20 runs parallel to a longitudinal axis of metal sheath 30. Grounding/bonding conductor 20 may be in direct contact with the inner surface 30A of metallic sheath 30 and may act in combination with sheath 30 to define a metallic sheath assembly which has an ohmic resistance value about equal to or lower than the ohmic resistance requirements necessary to qualify as an equipment grounding conductor. Alternatively, grounding/bonding conductor 20 may have sufficient ohmic resistance to qualify as an equipment grounding conductor.

Figure 3:
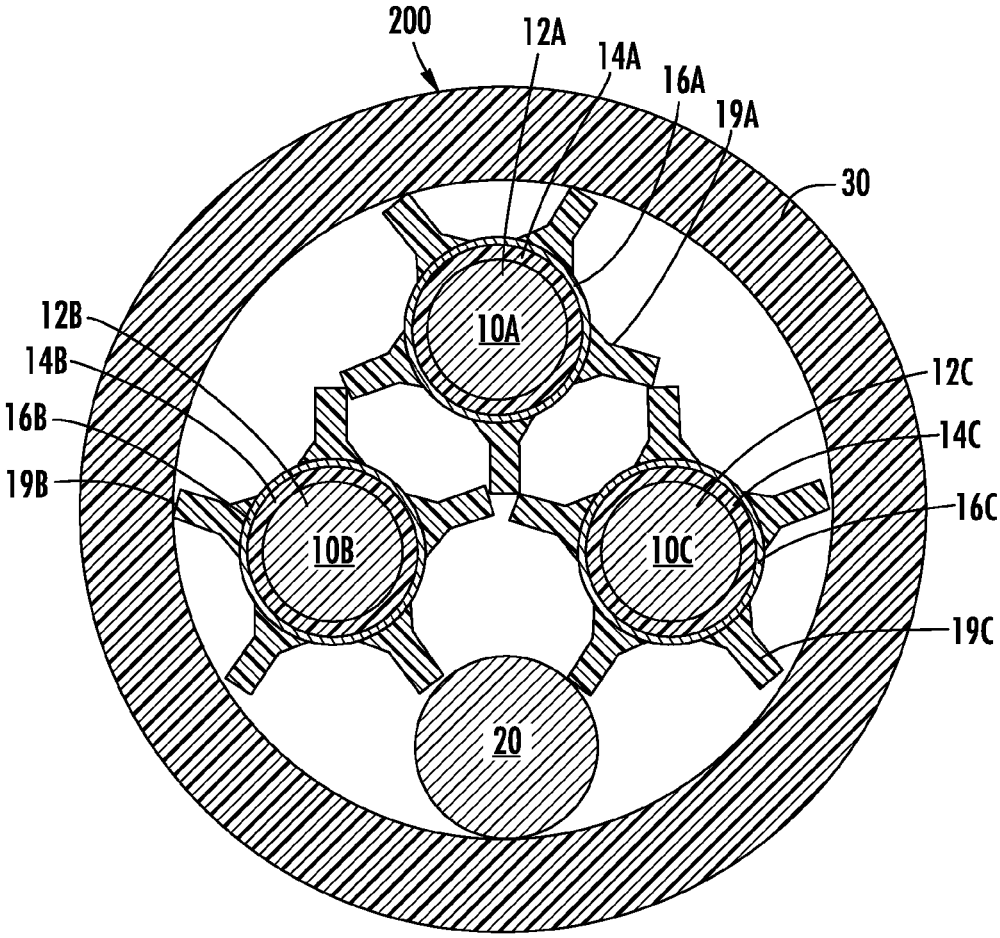
FIG. 3 is a cross-sectional view of an exemplary MC cable 200 in accordance with the present invention.

FIG. 3 is a cross-sectional view of an MC cable 200 having a metallic sheath 30 sized to receive a plurality of insulated electrical conductor assemblies 10A, 10B and 10C and at least one grounding/bonding conductor 20. Similar to the conductor assemblies associated with cable 100, conductor assemblies 10A-C include electrical conductors 12A-C having insulation layers 14A-C and jacket layers 16A-C, respectively. A protective layer 19A-C is a polymeric material adapted for extrusion about conventional insulation layer 14A-C and jacket layers 16A-C. The jacket layers 16A-C are respectively disposed between insulation layers 14A-C and protective layers 19A-C. Each protective layer 19A-C has a fluted or other longitudinally extending shape that provides separation and tension between conductor assemblies 10A-C as well as grounding/bonding conductor 20. In this manner, each protective layer 19A-C provides a mechanism for forcing grounding/bonding conductor 20 against the interior surface 30A of metallic sheath 30. Again, protective layers 19A-C provide mechanical strength to resist buckling, crushing and scuffing to the electrical conductors 12A-C.

Figure 4A:
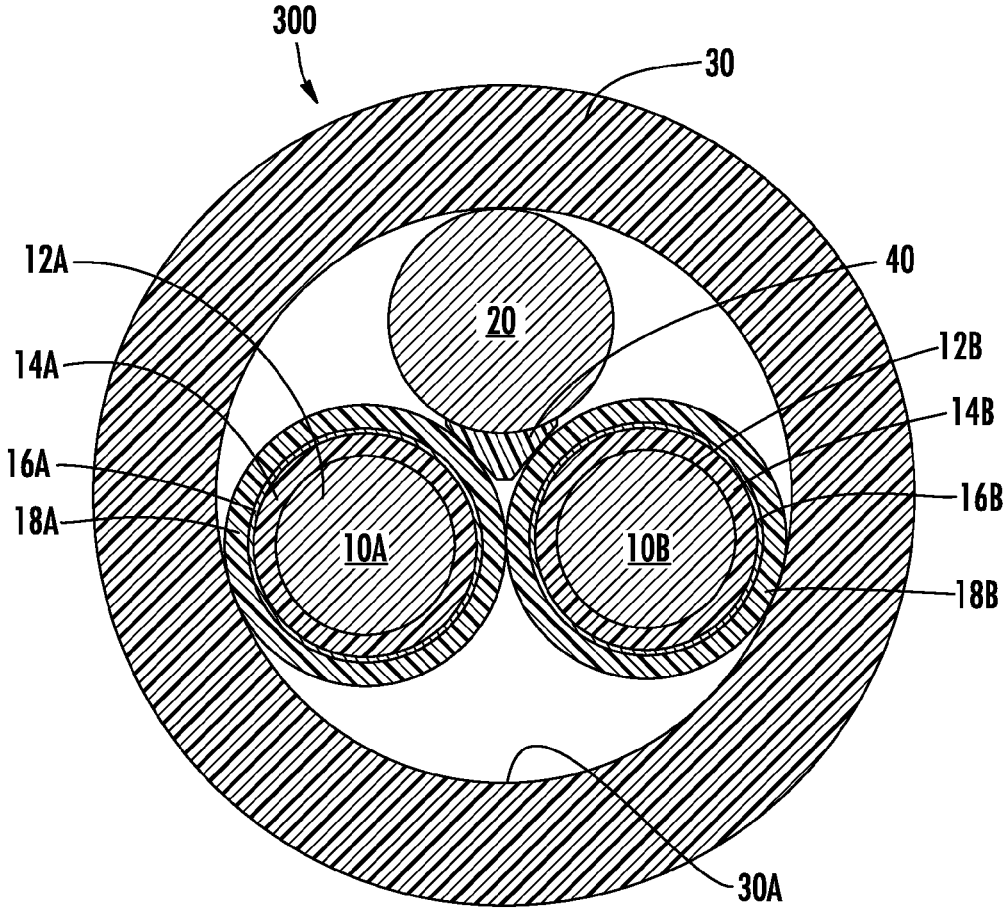
FIG. 4A is a cross-sectional view of an exemplary MC cable 300 in accordance with an embodiment of the present invention.

FIG. 4A is a cross-sectional view of MC cable 300 which includes a longitudinally extending member 40 disposed within the space between a first conductor assembly 10A, second conductor assembly 10B and grounding/bonding conductor 20. Longitudinally extending member 40 may be in the form of a filler, a tensile member, or a strength member and has a cross sectional shape that generally approximates the shape of the space between conductor assemblies 10A, 10B and grounding/bonding conductor 20. The insulated conductor assemblies 10A-B as well as the grounding/bonding conductor 20 extend longitudinally along the metallic sheath 30 such that the longitudinal axes of the conductors run parallel to a longitudinal axis of the sheath. Alternatively, electrical conductor assemblies 10A-B and ground conductor are cabled together along their longitudinally extending axes in a left or a right lay pattern. Similar to cable 100, grounding/bonding conductor 20 may be in direct contact with the inner surface 30A of metallic sheath 30 and may act in combination to define a metallic sheath assembly which has an ohmic resistance value about equal to or lower than the ohmic resistance requirements necessary to qualify as an equipment grounding conductor.

Figure 4B:
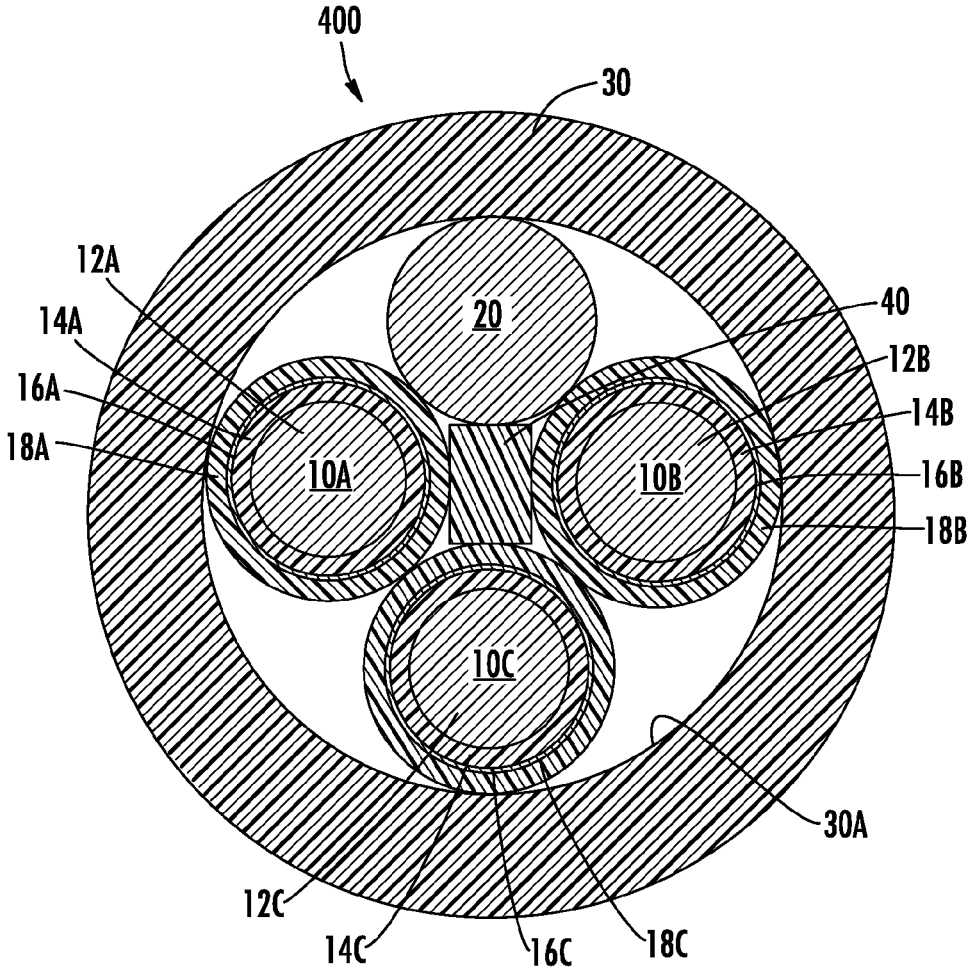
FIG. 4B is a cross sectional view of an exemplary MC cable 400 in accordance with an embodiment of the present invention.

FIG. 4B is a cross sectional view of MC cable 400 which includes a longitudinally extending member 40 disposed within the space between a first conductor assembly 10A, a second conductor assembly 10B, a third conductor assembly 10C and grounding/bonding conductor 20. Longitudinally extending member 40 has a cross sectional shape that generally approximates any appropriate shape (e.g. rectangle) useful between the conductor assemblies 10A-C and the grounding/bonding conductor 20 to provide spacing therebetween. Longitudinally extending member 40 may be in the form of a filler, a tensile member, or a shielding member and may include fibers or polymers that provide tensile strength to the cable 400. Again, conductor assemblies 10A-C may be cabled together while the grounding/bonding conductor 20 extends alongside the cabled assembly and in contact with the inner surface 30A of metallic sheath 30. Alternatively, conductor assemblies 10A-B and grounding/bonding conductor 20 are cabled together in a left or a right lay pattern.

In one embodiment, conductor assemblies 10A-C may be arranged in a coplanar relationship where the conductor assemblies are not cabled together. This is permitted for cable lengths of less than 15'. In addition, in certain uses for type MC cable, an SZ twister may be used to provide an alternating lay pattern for the conductor assemblies. When the conductor assemblies are arranged in a coplanar relationship, a saving of approximately one third of cabled conductor lengths is realized. In addition, the parallel circuit and grounding conductors within the metallic sheaths result in less conductor resistance per unit length of cable over twisted "cabled" conductors and also save the installer time by not having to untwist the conductors when terminating.

Figure 5:
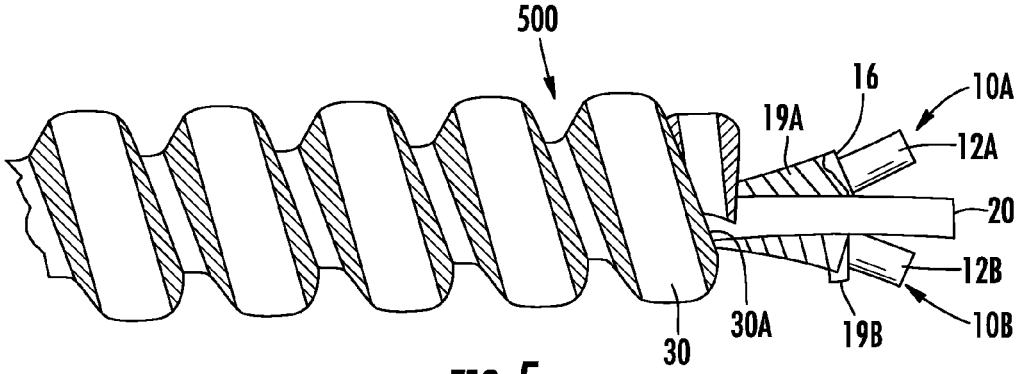
FIG. 5 is a side plan view of an exemplary MC cable 500 in accordance with an embodiment of the present invention.

FIG. 5 is a side plan view of MC cable 500 where the protective layer 19 is applied over the conventional insulation layer 14 (not shown) of each electrical conductor assembly 10A, 10B in the form of a protective wrap constructed from the polymeric material. Similar to cables 100, 200, 300 and 400, cable 500 includes a conventional THHN or THWN conductor having an insulation layer 14 and a jacket layer 16 disposed between the conductor 12 and the protective layer or wrap 19. The protective wrap 19 may be pliable to provide a conforming surface to the inside surface 30A of metal sheath 30. Protective wrap 19 may be fluted and may contain air bubbles along its length to provide added protection to the electrical conductors. Grounding/bonding conductor 20 is disposed within metal sheath 30 and may be cabled with conductor assemblies 10A-B. Alternatively, grounding/bonding conductor 20 may extend longitudinally along the metallic sheath 30 such that the longitudinal axis of the grounding/bonding conductor 20 runs parallel to a longitudinal axis of metal sheath 30. Grounding/bonding conductor 20 may be in direct contact with the inner surface 30A of metallic sheath 30 and may act in combination with sheath 30 to define a metallic sheath assembly which has an ohmic resistance value about equal to or lower than the ohmic resistance requirements necessary to qualify as an equipment grounding conductor. Alternatively, grounding/bonding conductor 20 may have sufficient ohmic resistance to qualify as an equipment grounding conductor.

Figure 6:
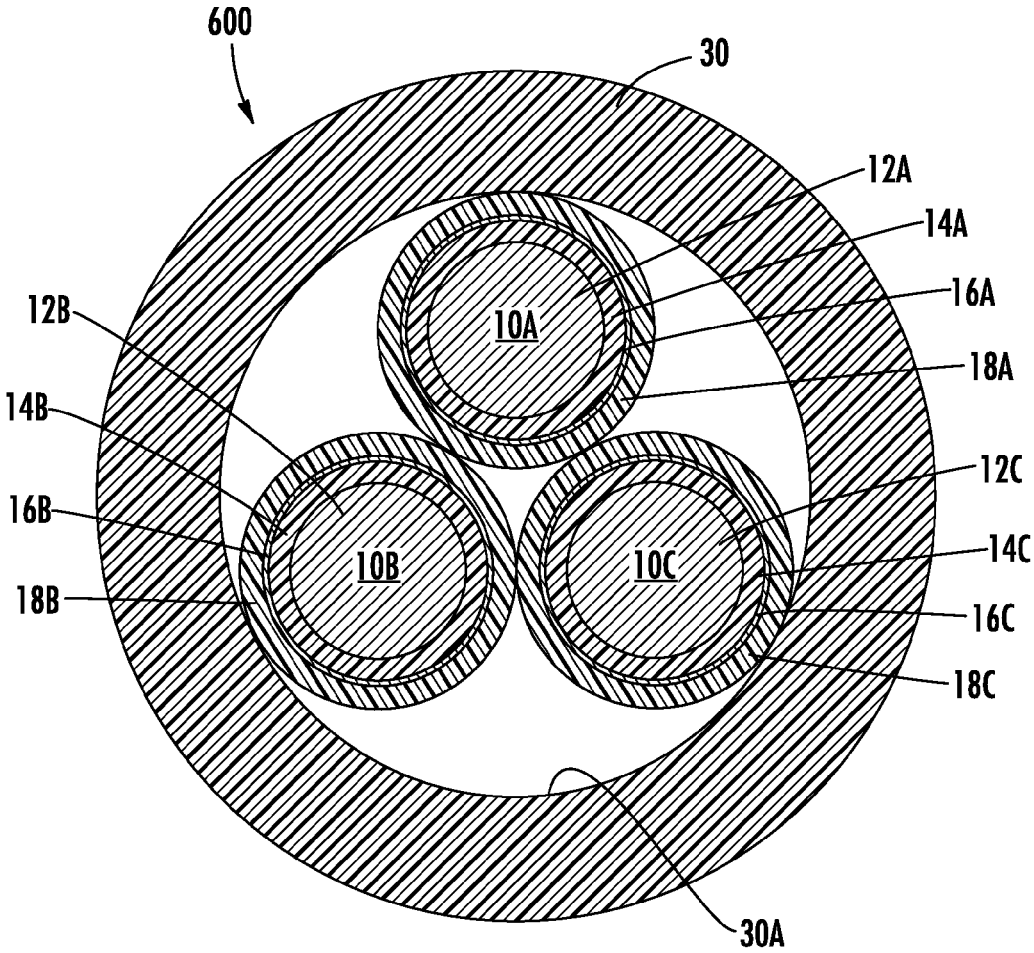
FIG. 6 is a cross sectional view of an exemplary MC cable 600 in accordance with an embodiment of the present invention.

FIG. 6 is a cross sectional view of MC cable 600 having insulated electrical conductor assemblies 10A, 10B, 10C housed within metallic sheath 30 sized to receive these assemblies. Similar to the electrical conductor assemblies 10 described above, each conductor assembly 10A-C is constructed from electrical conductors 12A-C having insulation layers 14A-C and protective layers 18A-C, respectively. Protective layers 18A-C are preferably formed from a polymeric material adapted for extrusion over jacket layers 16A-C. In this configuration, one of the conductor assemblies, for example assembly 10C, may be a ground conductor in which the metal sheath is not part of the equipment grounding function of MC cable 600. However, grounding conductor 10C has insulation layer 14C, jacket layer 16C and protective layer 18C similar to conductors 10A and 10B. Conductor assemblies 10A-C may be cabled together in a left or right lay pattern along the length of cable 600. Alternatively, conductor assemblies 10A-C may be arranged in a coplanar relationship where the conductor assemblies are not cabled together along the length of cable 600. This is permitted for cable lengths of less than 15'. In addition, in certain uses for type MC cable, an SZ twister may be used to provide an alternating lay pattern for the conductor assemblies. When the conductor assemblies are arranged in a coplanar relationship, a savings of approximately one third of the cabled conductor lengths is realized. In addition, the parallel circuit and grounding conductors within the metallic sheaths result in less conductor resistance per unit length of cable over twisted "cabled" conductors and also save the installer time by not having to untwist the conductors when terminating.

Figure 6A:
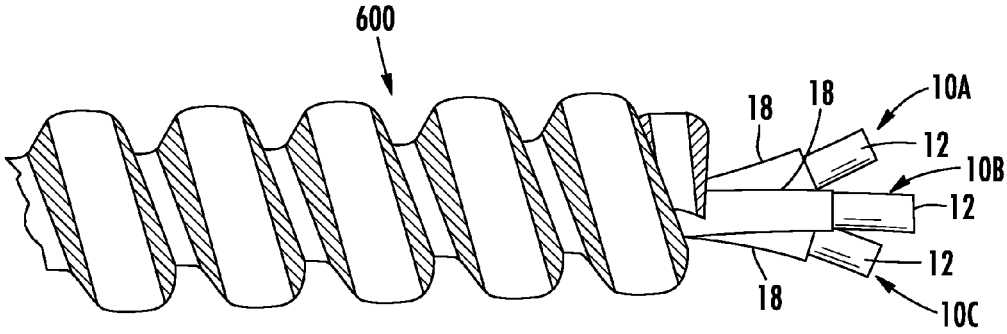
FIG. 6A is a side plan view of an exemplary MC cable 600 in accordance with an embodiment of the present invention.

FIG. 6A is a side plan view of cable 600 illustrating metallic sheath 30 sized to receive the three insulated electrical conductor assemblies 10A, 10B and 10C having electrical conductors 12 and protective layers 18. In this configuration, grounding conductor 10C has an ohmic resistance value about equal to or lower than the ohmic resistance requirements necessary to qualify as an equipment grounding conductor. Alternatively and as mentioned above with reference to FIGS. 2A and 5, a grounding/bonding conductor (not shown) may be disposed within cable 600 which is in contact with the inner surface 30A of metal sheath 30.

Figure 6B:
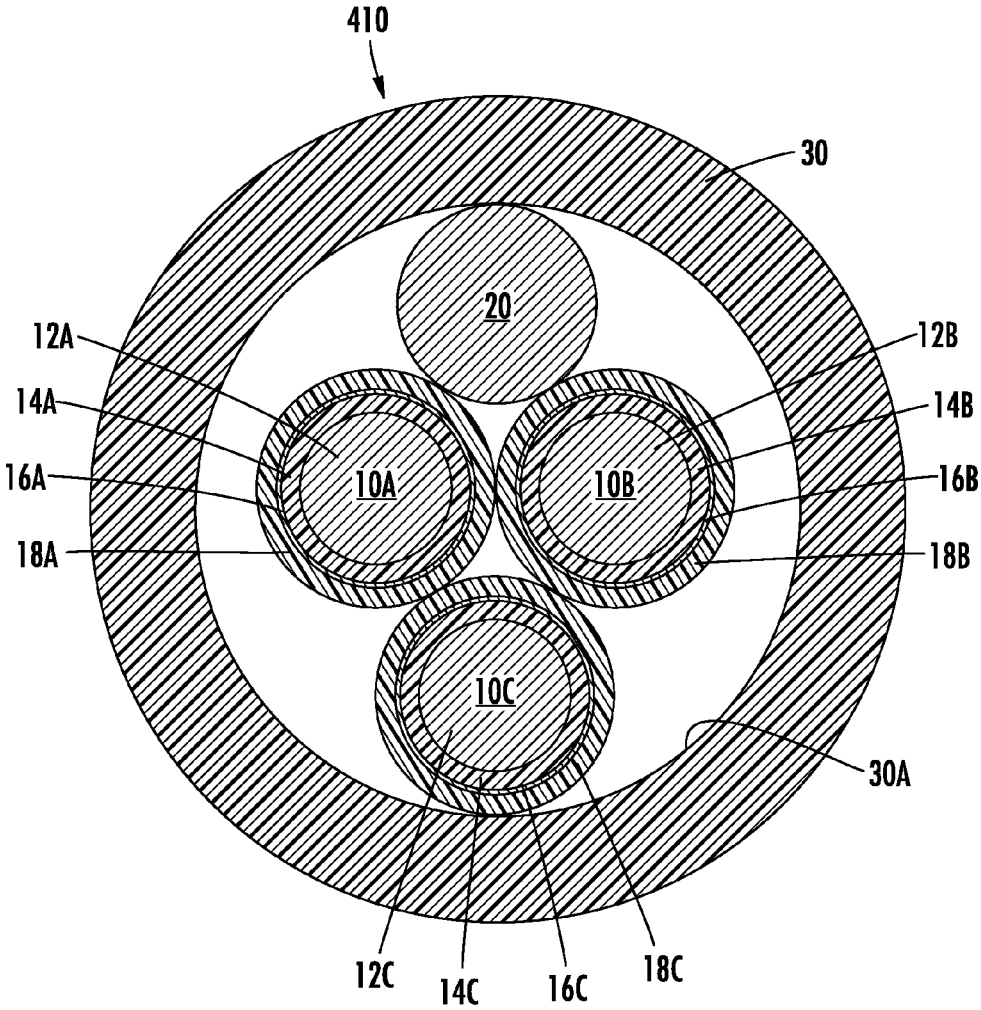
FIG. 6B is a cross sectional view of an exemplary MC cable in accordance with an embodiment of the present invention

FIG. 6B is a cross sectional view of cable 410 including a metal sheath 30 housing conductor assemblies 10A-C and a grounding/bonding conductor 20. The conductor assemblies 10A-C include a stranded or solid electrical conductor 12A-C having conventional concentric insulation layer 14A-C, a jacket layer 16A-C disposed over conventional insulation layer 14A-C and protective layer 18A-C disposed over jacket layer 16A-C respectively. The grounding/bonding conductor 20 together with metal sheath 30 form a metallic sheath assembly which has an ohmic resistance value about equal to or lower than the ohmic resistance requirements necessary to qualify as an equipment grounding conductor. In addition, one of the conductor assemblies 10A-C, for example assembly 10C, may be a grounding conductor insulated from metal sheath 30 as described above with reference to FIG. 6. This cable configuration is particularly suited for use in healthcare facilities where an insulated grounding conductor is desirable.

Figure 7:
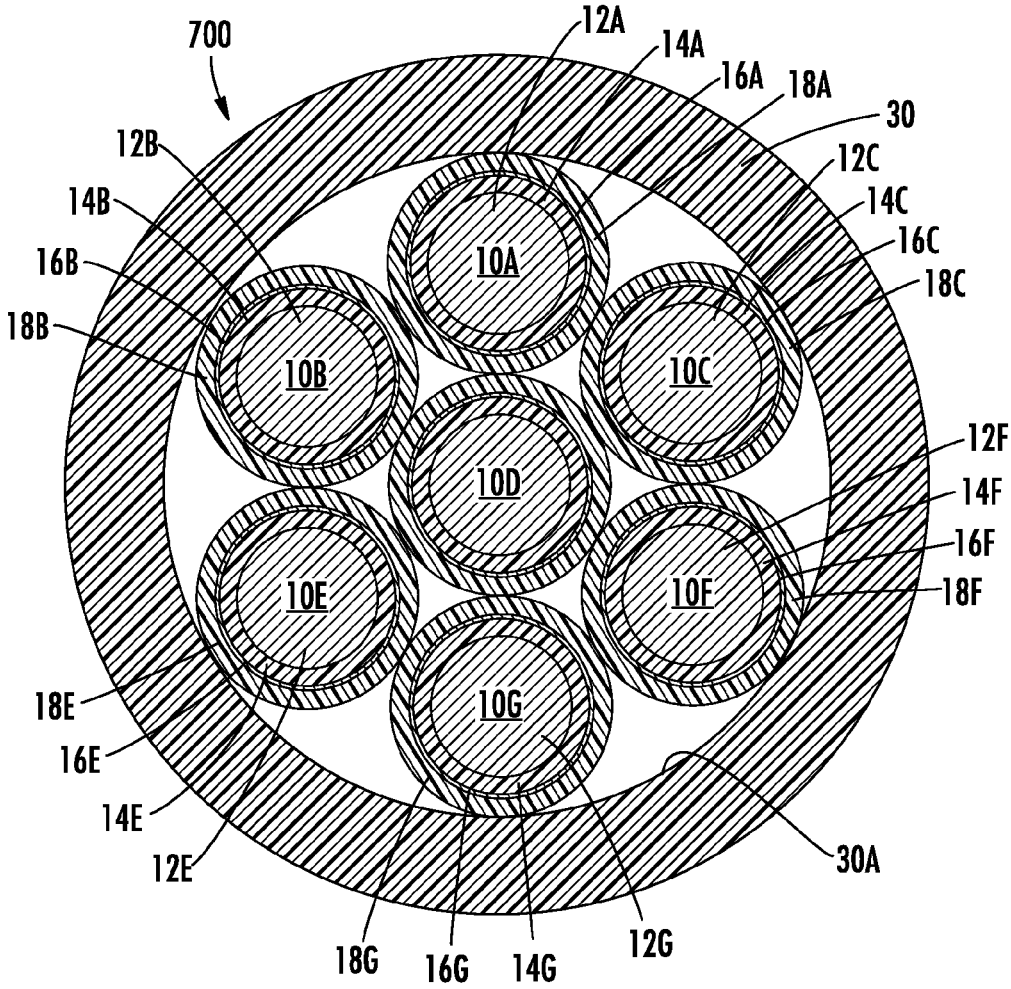
FIG. 7 is a cross sectional view of an exemplary MC cable 700 in accordance with an embodiment of the present invention.

FIG. 7 is a cross sectional view of cable 700 having metallic sheath 30 sized to receive a plurality of electrical conductor assemblies 10A-G. It should be noted that while seven conductor assemblies 10A-G are illustrated in FIG. 7, the number of conductor assemblies within the sheath 30 is only limited by the inner diameter of the sheath and the diameter of the conductor assemblies. Each of the conductor assemblies 10A-G have the same configuration as conductor assemblies 10 described above including conductors 12A-G, insulation layers 14A-G, jacket layers 16A-G and protective layers 18A-G. One of the conductor assemblies, for example assembly 10G may be a grounding conductor. Again, each of the protective layers 18A-G is constructed from a polymeric material adapted for coaxial extrusion. In a corrugated or continuous type MC cable, the sheath 30 may have an ohmic resistance value about equal to or lower than the ohmic resistance requirements necessary to qualify as an equipment grounding conductor.

Figure 7A:
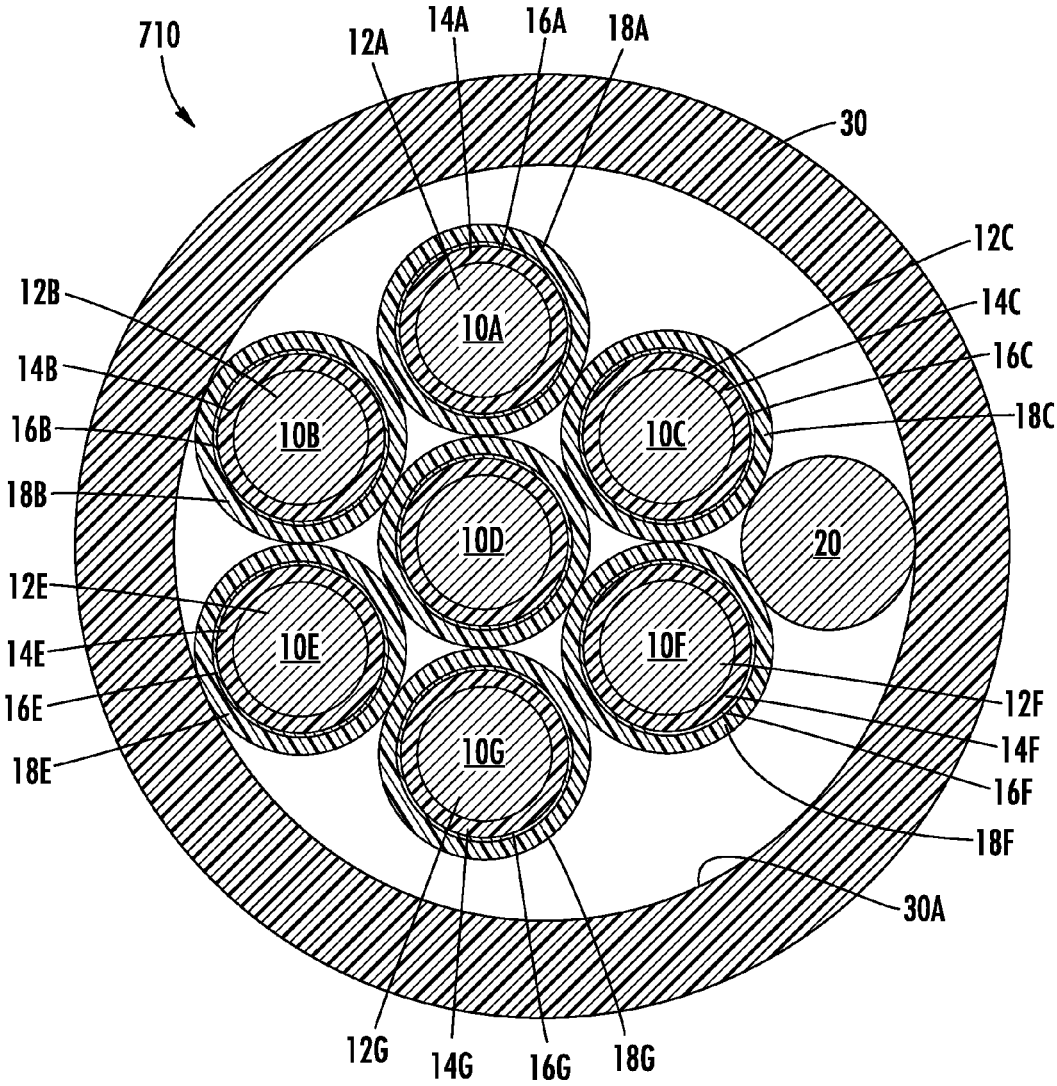
FIG. 7A is a cross sectional view of an exemplary MC cable 700 in accordance with an embodiment of the present invention.

FIG. 7A is a cross sectional view of cable 710 having metallic sheath 30 sized to receive a plurality of electrical conductor assemblies 10A-G and a grounding/bonding conductor 20. Each of the conductor assemblies 10A-G has the same configuration as conductor assemblies 10 described above including conductors 12A-G, insulation layers 14A-G disposed over the conductors 12A-G, jacket layers 16A-G disposed over insulation layers 14A-G and protective layers 18A-G disposed over 16A-G. Again, one of the conductor assemblies, for example assembly 10G, may be a grounding conductor which is insulated from metal sheath 30. This cable configuration is particularly suited for use in healthcare facilities where an insulated grounding conductor is desirable. The grounding/bonding conductor 20 is in contact with the inner surface 30A of metal sheath 30 which, together with metal sheath 30, form a metallic sheath assembly which has an ohmic resistance value about equal to or lower than the ohmic resistance requirements necessary to qualify as an equipment grounding conductor.

Figure 8:
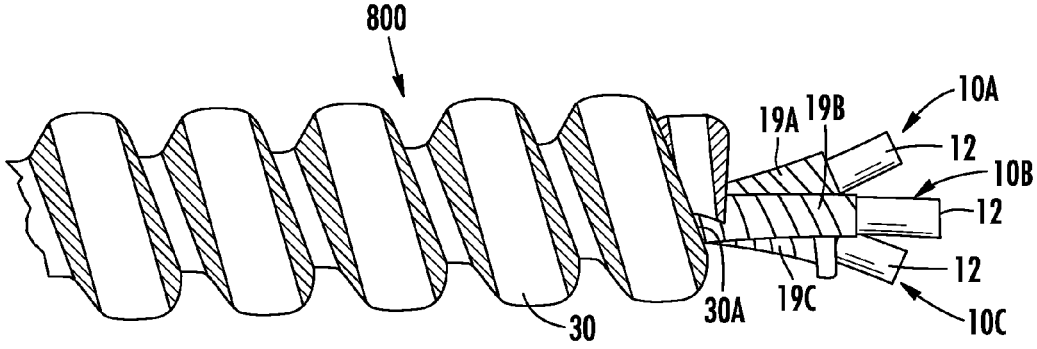
FIG. 8 is a side plan view of an exemplary MC cable 800 in accordance with an embodiment of the present invention.

FIG. 8 is a side plan view of cable 800 including a plurality of conductor assemblies 10A-C. Each of the conductor assemblies 10A-C include a conductor 12A-C, insulation layers (not shown) and protective polymeric wraps 19A-C applied over the insulation layers in the form of a protective wrap. One of the conductor assemblies 10A-C, for example assembly 10C, may be a grounding conductor. A jacket layer (not shown may) also be provided between the protective wrap 19A-C and the conventional insulation layer as described above with reference to layer 16. The protective layer may be pliable to provide a conforming surface to that of the inside surface 30A of metal sheath 30 or adjacently positioned conductor assemblies.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. A Metal-Clad cable comprising at least two conductor assemblies, each of said conductor assemblies having an electrical conductor, a layer of insulation extending around and along the length of each of said electrical conductors, a polymeric protective layer disposed around said insulation layer along the length of each of said electrical conductors, said polymeric protective layer comprising a material that is different from said layer of insulation;

a nylon jacket layer disposed between said insulation layer and said polymeric protective layer for each of said plurality of conductor assemblies; and a metal sheath disposed over said at least two conductor assemblies.

2. The Metal-Clad cable of claim 1 further comprising grounding/bonding conductor disposed within said metal sheath and in intimate contact with an interior surface of said metal sheath along the length of said cable and said combination having an ohmic resistance to qualify as an equipment grounding conductor.

3. The Metal-Clad cable of claim 2 wherein said grounding/bonding conductor is in cabled relationship with said at least two conductor assemblies.

4. The Metal-Clad cable of claim 2 wherein said metal sheath comprises a metal strip that is helically wound around said at least two electrical conductor assemblies and said grounding conductor, said metal strip having edges that interlock.

5. The Metal-Clad cable of claim 2 further comprising a longitudinally extending spacer member disposed between the conductor assemblies and the grounding/bonding conductor, said longitudinally extending member having a cross sectional shape that generally approximates the shape of the space between the conductor assemblies and the grounding/bonding conductor.

6. The Metal-Clad cable of claim 1 wherein said metal sheath comprises a metal strip that is helically wound around said at least two electrical conductor assemblies, said metal strip having edges that interlock.

7. The Metal-Clad cable of claim 1 wherein said metal sheath comprises a metal strip that is helically wound around said at least two electrical conductor assemblies and said grounding/bonding conductor, said metal strip having edges that interlock.

8. The Metal-Clad cable of claim 1 wherein said polymeric protective layer is adapted for extrusion about the insulation layer.

9. The Metal-Clad cable of claim 1 wherein said polymeric protective layer is adapted for extrusion about said jacket layer.

10. The Metal-Clad cable of claim 1 wherein said polymeric protective layer is disposed around said jacket layer along the length of each of said electrical conductors.

11. The Metal-Clad cable of claim 1 wherein said polymeric protective layer is wrapped around said insulation layer.

12. The Metal-Clad cable of claim 1 wherein said polymeric protective layer is foamed polymeric material having air pockets filled with gas.

13. The Metal-Clad cable of claim 1 wherein said polymeric protective layer has a non-uniform cross sectional profile around said insulation layer.

14. The Metal-Clad cable of claim 13 wherein said non-uniform cross sectional profile is constructed and arranged to provide separation of said at least two conductor assemblies.

15. The Metal-Clad cable of claim 13 further comprising a grounding/bonding conductor disposed within said metal sheath wherein said non-uniform cross sectional profile is configured to provide resilient force against a surface of said grounding/bonding conductor and configured to force said conductor into direct contact with an inner surface of said metal sheath.

16. The Metal-Clad cable of claim 1 comprising a longitudinally extending space member disposed between the conductor assemblies and the grounding/bonding conductor, said longitudinally extending member having a cross sectional shape that generally approximates the shape of the space between the conductor assemblies and the grounding/bonding conductor.

17. The Metal-Clad cable of claim 16 wherein said longitudinally extending member includes resilient properties sufficient to force said grounding/bonding conductor against the inner surface of said metal sheath.

18. The Metal-Clad cable of claim 1 further comprising a grounding conductor assembly providing a grounding path that is separate from said grounding/bonding conductor and said metal sheath electrical conductor, said grounding conductor assembly comprising a grounding conductor with a layer of insulation extending around and along the length of said grounding conductor, a polymeric protective layer disposed around said insulation layer along the length of said grounding conductor, and a jacket layer disposed between the layer of insulation and the polymeric protective layer.

19. The Metal-Clad cable of claim 1 wherein said polymeric protective layer is made from a material that is different from said nylon jacket layer to enable a user to remove said protective layer from said nylon jacket layer during installation of said MC cable.

20. The Metal-Clad cable of claim 1 wherein each of the at least two conductor assemblies are individually wrapped with said layer of insulation, said nylon jacket layer, and said polymeric protective layer.

21. The Metal-Clad cable of claim 1 wherein the layer of insulation comprises polyvinylchloride.

22. The Metal-Clad cable of claim 1 wherein the polymeric protective layer, is removable from the insulation layer and the nylon jacket layer.

23. The Metal-Clad cable of claim 1 wherein the polymeric protective layer provides continued mechanical protection to the associated conductor.

24. The Metal-Clad cable of claim 1 further comprising a bare grounding/bonding conductor in cabled relationship with said at least two conductor assemblies.

25. The Metal-Clad cable of claim 24, wherein the grounding/bonding conductor is disposed within said metal sheath and is in intimate contact with an interior surface of said metal sheath along the length of said cable.

* * * * *